US009827769B2

(12) United States Patent
Kobayashi

(10) Patent No.: US 9,827,769 B2
(45) Date of Patent: Nov. 28, 2017

(54) LIQUID DISCHARGE DEVICE AND HEAD CLEANING METHOD

(71) Applicant: SEIKO EPSON CORPORATION, Tokyo (JP)

(72) Inventor: Yoshihiro Kobayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 3 days.

(21) Appl. No.: 15/051,839

(22) Filed: Feb. 24, 2016

(65) Prior Publication Data

US 2016/0263898 A1 Sep. 15, 2016

(30) Foreign Application Priority Data

Mar. 11, 2015 (JP) ..... 2015-048074

(51) Int. Cl.
*B41J 2/165* (2006.01)

(52) U.S. Cl.
CPC ..... *B41J 2/16552* (2013.01); *B41J 2/16538* (2013.01); *B41J 2002/16558* (2013.01)

(58) Field of Classification Search
USPC ..... 347/328–38
See application file for complete search history.

(56) References Cited

U.S. PATENT DOCUMENTS 6,206,497 B1 * 3/2001 Miura ..... B41J 2/16538 347/28
6,609,780 B2 * 8/2003 Sugiyama ..... B41J 2/16532 347/23
8,465,121 B2 * 6/2013 Yamada ..... B41J 2/16526 347/33
9,085,158 B2 * 7/2015 Kobayashi ..... B41J 2/16538
9,132,641 B2 * 9/2015 Shimizu ..... B41J 2/16535
9,132,642 B2 * 9/2015 Onodera ..... B41J 2/16538
9,139,007 B2 * 9/2015 Onodera ..... B41J 2/16538
9,199,468 B2 * 12/2015 Kobayashi ..... B41J 2/16535
2003/0007031 A1 * 1/2003 Sugiyama ..... B41J 2/16532 347/33
2005/0035991 A1 * 2/2005 Fredrickson ..... B41J 2/16535 347/33
2006/0268050 A1 * 11/2006 Sonobe ..... B41J 2/16535 347/29
2010/0079539 A1 * 4/2010 Inoue ..... B41J 2/16535 347/33
2010/0201738 A1 * 8/2010 Yamaguchi ..... B41J 2/16585 347/31

(Continued)

FOREIGN PATENT DOCUMENTS

JP 2014-172238 A 9/2014

*Primary Examiner* — Matthew Luu
*Assistant Examiner* — Lily Kemathe
(74) *Attorney, Agent, or Firm* — Workman Nydegger

(57) ABSTRACT

There is provided a liquid discharge device including: a wiping member that performs wiping on a nozzle forming surface by being caused to perform relative movement on the nozzle forming surface while coming into contact with the nozzle forming surface; a cleaning liquid supply section that supplies cleaning liquid to at least one of a head and the wiping member; and a circulation speed adjustment section that is capable of adjusting a circulation speed of the liquid, which is circulated between a liquid storage section and the head, to a second speed which is faster than the first speed. In addition, the circulation speed during the wiping is the second speed.

5 Claims, 16 Drawing Sheets

(56) References Cited

U.S. PATENT DOCUMENTS

| | | | | |
|---|---|---|---|---|
| 2010/0321425 | A1* | 12/2010 | Kanke | B41J 2/1652 347/6 |
| 2012/0249673 | A1* | 10/2012 | Mita | B41J 2/16588 347/33 |
| 2014/0152739 | A1* | 6/2014 | Fukuda | B41J 2/16535 347/31 |
| 2014/0247305 | A1* | 9/2014 | Fukuda | B41J 2/16535 347/33 |
| 2014/0253633 | A1* | 9/2014 | Kobayashi | B41J 2/16535 347/33 |
| 2014/0253634 | A1* | 9/2014 | Kobayashi | B41J 2/16538 347/33 |
| 2014/0292911 | A1* | 10/2014 | Kajimoto | B41J 2/16535 347/29 |
| 2014/0292915 | A1* | 10/2014 | Onodera | B41J 2/16538 347/33 |
| 2014/0292918 | A1* | 10/2014 | Shimizu | B41J 2/16535 347/33 |
| 2016/0303858 | A1* | 10/2016 | Ando | B41J 2/16535 |

* cited by examiner

FIG. 3A

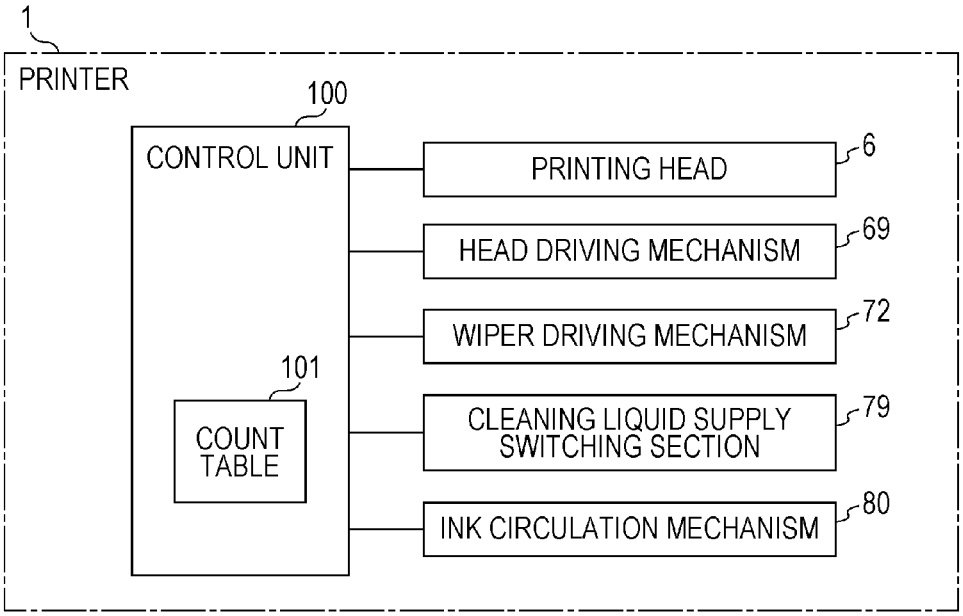

FIG. 3B

| PRINTING TIME | NUMBER Nmax OF REPETITIONS OF RECIPROCATIVE CLEANING PROCESS | | | | | |
|---|---|---|---|---|---|---|
| (MINUTE) | Wh | C | M | K | Y | Dv |
| 0 | TWO TIMES | TWO TIMES | TWO TIMES | TWO TIMES | TWO TIMES | TWO TIMES |
| 0 TO 10 | FIVE TIMES | FIVE TIMES | FIVE TIMES | FIVE TIMES | FIVE TIMES | FIVE TIMES |
| 10 TO 20 | FIVE TIMES | FIVE TIMES | FIVE TIMES | FIVE TIMES | FIVE TIMES | FIVE TIMES |
| 20 TO 30 | FIVE TIMES | TEN TIMES | TEN TIMES | TEN TIMES | FIVE TIMES | FIVE TIMES |
| 30 OR MORE | FIVE TIMES | TWENTY TIMES | TWENTY TIMES | TWENTY TIMES | FIVE TIMES | FIVE TIMES |

BACK PRESSURE: NEGATIVE PRESSURE

BACK PRESSURE: POSITIVE PRESSURE

LIQUID DISCHARGE DEVICE AND HEAD CLEANING METHOD

BACKGROUND

1. Technical Field

The present invention relates to a liquid discharge device, which discharges liquid from nozzles provided on the nozzle forming surface of a head, and a method of cleaning the head of the device.

2. Related Art

In the related art, a liquid discharge device, such as an ink jet printer, which discharges liquid, such as ink, from the nozzles of a discharge head, is known. In such a device, there is a case in which liquid discharged from the nozzles adheres to the nozzle forming surface of the discharge head. If the liquid proceed to adhere to the nozzle forming surface, the liquid is not appropriately discharged from the nozzles, and thus there is a problem in that deterioration in image quality is caused. Here, various technologies are proposed to remove the liquid which adheres to the nozzle forming surface of the discharge head.

For example, in a liquid discharge device disclosed in JP-A-2014-172238, cleaning liquid is supplied to a head, and then a wiping member performs relative movement on a nozzle forming surface in a state in which the wiping member comes into contact with the nozzle forming surface. Accordingly, chemical cleaning and physical cleaning are performed in parallel by the cleaning liquid and the wiping member, respectively, and thus the cleaning efficiency of the nozzle forming surface is optimized.

Foreign substances, which adhere to the nozzle forming surface, drop out due to the cleaning liquid. However, there is a case in which the dropped-out foreign substances are pushed to the side of the nozzle forming surface during the time when the wiping member performs relative movement on the nozzle forming surface, and thus the foreign substances rub the inside of the nozzles. Further, there is a case in which this becomes one of the factors of defective discharge.

SUMMARY

An advantage of some aspects of the invention is to provide a technology for preventing foreign substances from rubbing nozzles which are provided on a nozzle forming surface when cleaning is performed on the nozzle forming surface by combining chemical cleaning through the supply of cleaning liquid to the nozzle forming surface of a head with physical cleaning through the relative movement of a wiping member on the nozzle forming surface.

The invention can be realized in the following aspects.

According to an aspect of the invention, there is provided a liquid discharge device, which discharges liquid from nozzles that are formed on a nozzle forming surface of a head while circulating the liquid between a liquid storage section and the head at a first speed, the liquid discharge device including: a wiping member that performs wiping on the nozzle forming surface by being caused to perform relative movement on the nozzle forming surface while coming into contact with the nozzle forming surface; a cleaning liquid supply section that supplies cleaning liquid to at least one of the head and the wiping member; and a circulation speed adjustment section that is capable of adjusting a circulation speed of the liquid, which is circulated between the liquid storage section and the head, to a second speed which is faster than the first speed. The circulation speed during the wiping is the second speed.

In addition, according to another aspect of the invention, there is provided a head cleaning method for cleaning a head in a liquid discharge device, which discharges liquid from nozzles that are formed on a nozzle forming surface of the head while circulating the liquid between a liquid storage section and the head at a first speed, the head cleaning method including: supplying cleaning liquid to at least one of a wiping member, which comes into contact with the nozzle forming surface, and the head; performing wiping on the nozzle forming surface by causing the wiping member and the nozzle forming surface to perform relative movement; and adjusting a circulation speed of the liquid, which are circulated between a liquid storage section and the head during the wiping, to a second speed which is faster than the first speed.

In this case, the wiping operation is performed by the wiping member using the cleaning liquid. When cleaning (hereinafter, referred to as "combined head cleaning"), in which chemical cleaning through the cleaning liquid is combined with physical cleaning through wiping, is performed in this manner, foreign substances are left from the nozzle forming surface by the cleaning liquid and pushed to the sides of the nozzles by the wiping member. However, in the invention, the circulation speed of the liquid is increased to the second speed, which is faster than the speed (first speed) acquired when the liquid is discharged, during the combined head cleaning operation, and thus the back pressure of the nozzles becomes positive pressure during the combined head cleaning operation. As a result, it is possible to prevent the foreign substances, which are left from the nozzle forming surface, from entering the nozzles.

Here, the liquid discharge device may cause the wiping member to perform the relative movement in a first direction along the nozzle forming surface and to perform the relative movement in a second direction which is opposite to the first direction, that is, to perform the combined head cleaning on both a forward path side and a reverse path side while causing the wiping member to perform a reciprocating operation. Therefore, it is possible to enhance cleaning effects through the combined head cleaning.

In addition, the cleaning liquid supply section may supply the cleaning liquid before the wiping member performs the relative movement in the first direction and the wiping member performs the relative movement in the second direction. In this case, the cleaning liquid is rich when both the combined head cleaning on the forward path side and the combined head cleaning on the reverse path side are performed, and thus it is possible to enhance the cleaning effects.

In addition, the cleaning liquid supply section may supply the cleaning liquid before the wiping member is caused to perform the relative movement in one of the first direction and the second direction, and the circulation speed adjustment section may adjust the circulation speed to a third speed, which is faster than the second speed, when the wiping member is caused to perform the relative movement on the other side of the first direction and the second direction. In this case, the wiping member passes through the nozzles when the wiping member performs the relative movement to the other side. However, the back pressure of the nozzles, which is acquired when the wiping member passes through the nozzles, is further higher than the back pressure which is acquired in a case of the wiping operation, and thus it is possible to securely prevent the foreign substances from rubbing the nozzles by the wiping member.

Therefore, it is possible to securely prevent the foreign substances from penetrating into the nozzles.

In addition, the number of repetitions of the reciprocating operation may be changed according to the time in which the liquid is discharged from nozzles, that is, printing time. The amount of liquid and foreign substances, which adhere to the nozzle forming surface, increases according to the increase in the time, and thus it is difficult to perform removal from the nozzle forming surface. Here, cleaning which is suitable for the amount of adhesion is performed by changing the number of repetitions of combined head cleaning according to the printing time. Therefore, excessive use of the cleaning liquid is prevented, and thus it is possible to reduce running costs.

Further, a light irradiation device may be provided that causes the liquid, which is discharged from the nozzles and lands on a medium, to harden by irradiating the liquid with light, and the number of repetitions of the reciprocating operation may be changed according to a distance from the light irradiation device to the head. Although the liquid, which adheres to the nozzle forming surface, hardens when light from the light irradiation device is received, the influence thereof is different according to the distance. That is, when the distance is short, a hardening degree is large, and thus it is difficult to perform removal from the nozzle forming surface. Here, when the number of repetitions of the reciprocating operation, that is, the number of repetitions of combined head cleaning is changed according to the distance, it is possible to perform cleaning which is suitable for a hardening degree. Therefore, excessive use of the cleaning liquid is prevented, and thus it is possible to reduce running costs.

The entirety of the plurality of components which have the above-described respective forms of the invention are not necessarily required. In order to solve a part or all of the above-described problems, or in order to implement a part or all of the advantages described in the specification, it is possible to appropriately perform modification, removal, or replacement with another new component on a partial component of the plurality of component, thereby removing a part of limited content. In addition, in order to solve a part or all of the above-described problems, or in order to realize a part or all of the advantages described in the specification, the invention can be realized in an independent form by combining parts or all of the technical characteristics included in the form of the above-described invention with parts or all of the technical characteristics included in another form of the above-described invention.

BRIEF DESCRIPTION OF THE DRAWINGS

The invention will be described with reference to the accompanying drawings, wherein like numbers reference like elements.

FIG. 3A is a block diagram illustrating an example of the electrical configuration according to the maintenance system.

FIG. 3B is a diagram illustrating an example of data which indicates the relationship between the printing time and the number of repetitions of a combined head cleaning operation.

DESCRIPTION OF EXEMPLARY EMBODIMENTS

First Embodiment

Figure 1:
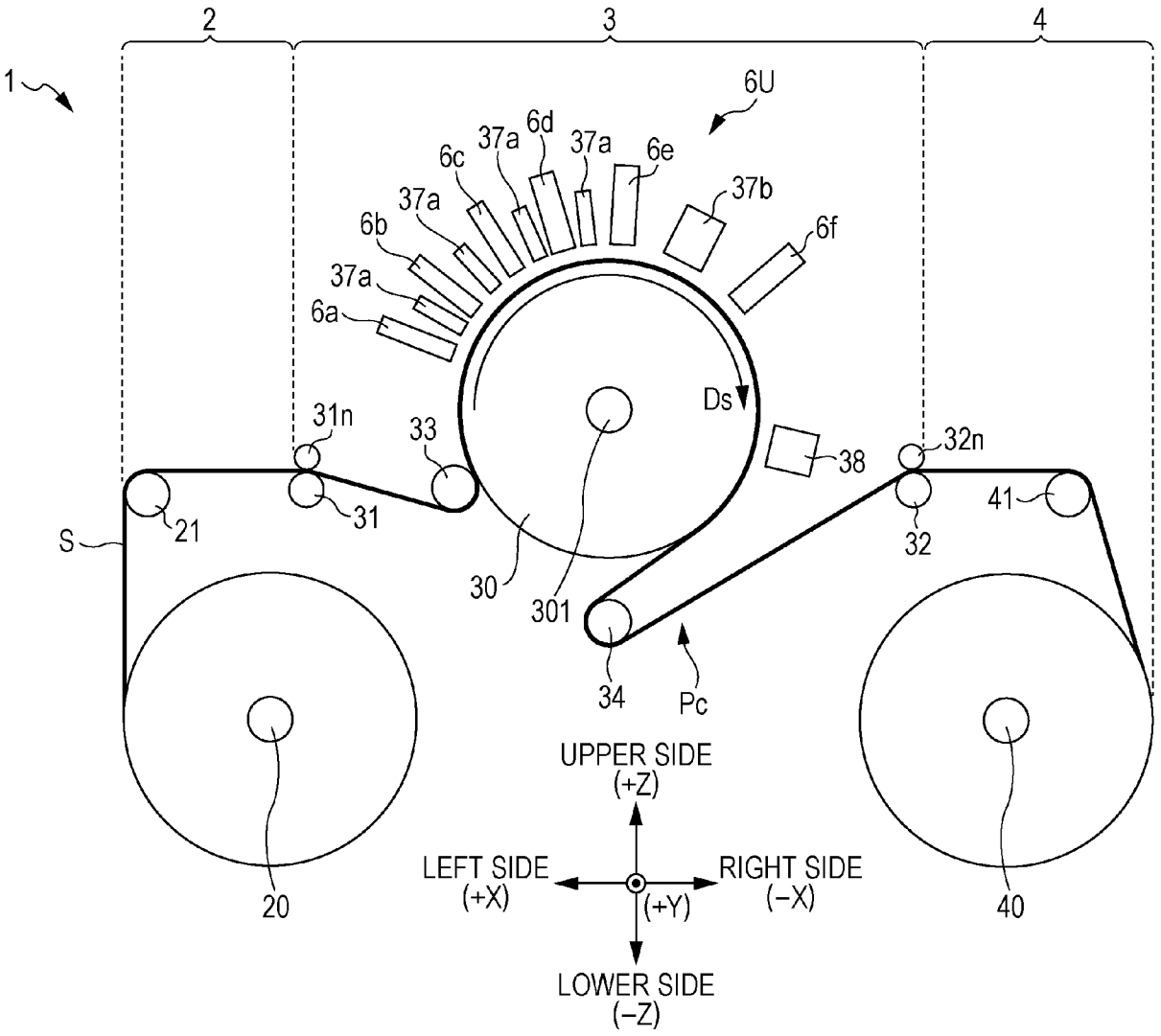
FIG. 1 is a front view schematically illustrating the configuration of a printer to which the invention can be applied.

Hereinafter, the configuration of a printer which includes an ink end detection device that is an example of a pressure change detection device of the invention will be described with reference to the accompanying drawings. FIG. 1 is a front view schematically illustrating the configuration of a printer to which a pressure change detection device according to a first embodiment of the invention can be applied. Meanwhile, in the drawings below, in order to make the relation of placement between the respective sections of a printer 1 clear, a 3-dimensional coordinate system, which includes a horizontal direction X, a front and rear direction Y, and a vertical direction Z of the printer 1, if necessary.

As illustrated in FIG. 1, in the printer 1, a delivery section 2, a process section 3, and a winding section 4 are arranged in the horizontal direction. The delivery section 2 and the winding section 4 respectively include a delivery shaft 20 and a winding shaft 40. Further, both the ends of a sheet S (web) are wound to the delivery section 2 and the winding section 4 in a roll shape, and are stretched therebetween. The sheet S, which is stretched in this manner, is transported from the delivery shaft 20 to the process section 3 along the transport path Pc and receives an image recording process by a printing unit 6U, and is then transported to the winding shaft 40. The kind of the sheet S is divided broadly into a paper system and a film system. More specifically, the paper system includes wood free paper, cast paper, art paper, coated paper, and the like, and the film system includes synthetic paper, Polyethylene terephthalate (PET), Polypropylene (PP), and the like. Meanwhile, in the description below, a surface, on which an image is recorded, is called a front surface, and an opposite side surface thereto is called a back surface in both the surfaces of the sheet S.

The delivery section 2 includes the delivery shaft 20 which winds the end of the sheet S, and a driven roller 21 which winds the sheet S which is drawn from the delivery shaft 20. The delivery shaft 20 winds and supports the end of the sheet S in a state in which the front surface of the sheet S faces outwards. Further, when then delivery shaft 20 rotates clockwise in FIG. 1, the sheet S, which is wound to the delivery shaft 20, is delivered to the process section 3 through the driven roller 21.

In the process section 3, while the sheet S which is delivered from the delivery section 2 is supported by a platen drum 30, an image is recorded on the sheet S using the printing unit 6U. That is, the printing unit 6U includes a plurality of printing heads 6*a* to 6*f* which are placed along the front surface of the platen drum 30. When the printing heads 6*a* to 6*f* discharge ink to the sheet S, which is supported by the front surface of the platen drum 30, the image is recorded on the sheet S. In the process section 3, a preceding driving roller 31 and a following driving roller 32 are provided on both sides of the platen drum 30, and the sheet S, which is transported from the preceding driving roller 31 to the following driving roller 32, is supported by the platen drum 30, and image printing is performed thereon.

The preceding driving roller 31 includes a plurality of minute projections, which are formed through spraying, on an outer peripheral surface, and winds up the sheet S, which is delivered from the delivery section 2, from the side of the back surface. Further, the preceding driving roller 31 rotates clockwise in FIG. 1, and thus the sheet S, which is delivered from the delivery section 2, is transported to the platen drum 30 through the driven roller 33. Meanwhile, a nip roller 31*n* is provided for the preceding driving roller 31. The nip roller 31*n* comes into contact with the front surface of the sheet S in a state in which the nip roller 31*n* is biased to the side of the preceding driving roller 31, and inserts the sheet S between the nip roller 31*n* and the preceding driving roller 31. Accordingly, the friction force between the preceding driving roller 31 and the sheet S is secured, and thus it is possible to securely transport the sheet S by the preceding driving roller 31.

The platen drum 30 is a cylindrical drum which is supported to be rotatable by a support mechanism which is not shown in the drawing, and winds the sheet S, which is transported from the preceding driving roller 31 to the following driving roller 32, from the back surface side. The platen drum 30 receives friction force between the platen drum 30 and the sheet S, performs driven rotation in a transport direction Ds of the sheet S, and supports the sheet S from the back surface side. In addition, in the process section 3, driven rollers 33 and 34, which fold back the sheet S on both sides of the winding section of the platen drum 30, are provided. Here, the driven roller 33 winds the front surface of the sheet S between the preceding driving roller 31 and the platen drum 30, and folds back the sheet S. In contrast, the driven roller 34 winds the front surface of the sheet S between the platen drum 30 and the following driving roller 32, and folds back the sheet S. As described above, the sheet S is folded back for the platen drum 30 on both the upstream side and the downstream side in the transport direction Ds, and thus it is possible to secure a long section which winds the sheet S to be sent to the platen drum 30.

The following driving roller 32 includes a plurality of minute projections, which are formed through spraying, on the outer peripheral surface, and winds the sheet S, which is transported from the platen drum 30 through the driven roller 34, from the back surface side. Further, the following driving roller 32 rotates clockwise in FIG. 1, thereby transporting the sheet S to the winding section 4. Meanwhile, the nip roller 32*n* is provided for the following driving roller 32. The nip roller 32*n* comes into contact with the front surface of the sheet S in a state in which the nip roller 32*n* is energized to the side of the following driving roller 32, and inserts the sheet S between the nip roller 32*n* and the following driving roller 32. Accordingly, the friction force between the following driving roller 32 and the sheet S is secured, and thus it is possible to securely transport the sheet S by the following driving roller 32.

As described above, the sheet S, which is transported from the preceding driving roller 31 to the following driving roller 32, is supported by the outer peripheral surface of the platen drum 30. Further, in the process section 3, there are provided with the printing head 6*a* for performing solid printing on the front surface of the sheet S which is supported by the platen drum 30, the plurality of printing heads 6*b* to 6*e* respectively corresponding to different colors for recording a color image, and the printing head 6*f* for printing colorless and transparent clear ink on the color image in order to protect and brighten the image. More specifically, six printing heads 6*a* to 6*f* respectively corresponding to white, cyan, magenta, black, and clear are placed in this order of colors along the transport direction Ds.

The printing heads 6*a* to 6*f* have the same configuration as each other, and face the front surface of the sheet S which is supported by the platen drum 30 with a slight amount of clearance. Further, relevant color ink is discharged from a nozzle which is open toward the front surface of the platen drum 30 using an ink jet method. Accordingly, ink is discharged to the sheet S, which is transported along the transport direction Ds, and thus the solid white image or the color image is formed on the front surface of the sheet S. In addition, a clear ink layer is formed on the image which is formed as described above, and the image is protected.

Here, ultraviolet (UV) ink (photosetting ink), which hardens when ink is irradiated with ultraviolet (light), is used as ink (recording liquid). Here, UV lamps 37*a* and 37*b* are provided to cause ink to harden and to be fixed to the sheet S. Meanwhile, ink hardening is divided into two steps, such as temporary hardening and main hardening, and then performed. The UV lamps 37*a* for temporary hardening are arranged between the respective printing heads 6*a* to 6*d*. That is, when the UV lamp 37*a* irradiates weak ultraviolet, ink hardens (performs temporary hardening) to a degree at which the shape of the ink does not collapse, and thus the ink does not completely harden. In contrast, on the downstream side of the transport direction Ds for the printing heads 6*a* to 6*e*, the UV lamp 37*b* for main hardening is provided. That is, when the UV lamp 37*b* irradiates weaker ultraviolet than the UV lamps 37*a*, the ink completely hardens (performs main hardening). When the temporary hardening and the main hardening are performed as described above, it is possible to fix the solid white, which is formed by the printing head 6*a*, and the color image, which is formed by the printing heads 6*b* to 6*e*, on the front surface of the sheet S.

Further, on the downstream side of the transport direction Ds for the UV lamp 37*b*, the printing head 6*f* is arranged to face the front surface of the platen drum 30. The printing head 6*f* has the same configuration as each of the printing heads 6*a* to 6*e*, and discharges transparent UV ink to the front surface of the sheet S using the ink jet method. That is, the printing head 6*f* faces the front surface of the sheet S, which is supported by the platen drum 30, with a slight amount of clearance, and discharges transparent ink using the ink jet method. Accordingly, transparent ink is further discharged to the solid white, which is formed by the printing head 6*a*, and the color image which is formed by the printing heads 6*b* to 6*e* corresponding to four colors.

In addition, a UV lamp 38 is provided on the downstream side of the transport direction Ds for the printing head 6*f*. When the UV lamp 38 irradiates strong ultraviolet light, the transparent ink, which is discharged by the printing head 6*f*, completely hardens (main hardening). Accordingly, it is possible to fix transparent ink on the front surface of the sheet S.

As above, in the process section 3, the discharge or hardening of ink is appropriately performed on the sheet S, which is supported by the platen drum 30, and thus the color image, which is coated with transparent ink, is formed. Further, the sheet S, on which the color image is formed, is transported to the winding section 4 by the following driving roller 32.

The winding section 4 includes the winding shaft 40 which winds the end of the sheet S and the driven roller 41 which winds the sheet S to be transported to the winding shaft 40. The winding shaft 40 winds and supports the end of the sheet S in a state in which the front surface of the sheet S faces the outside. Further, when the winding shaft 40 rotates clockwise in FIG. 1, the sheet S is wound to the winding shaft 40 through the driven roller 41.

Figure 2:
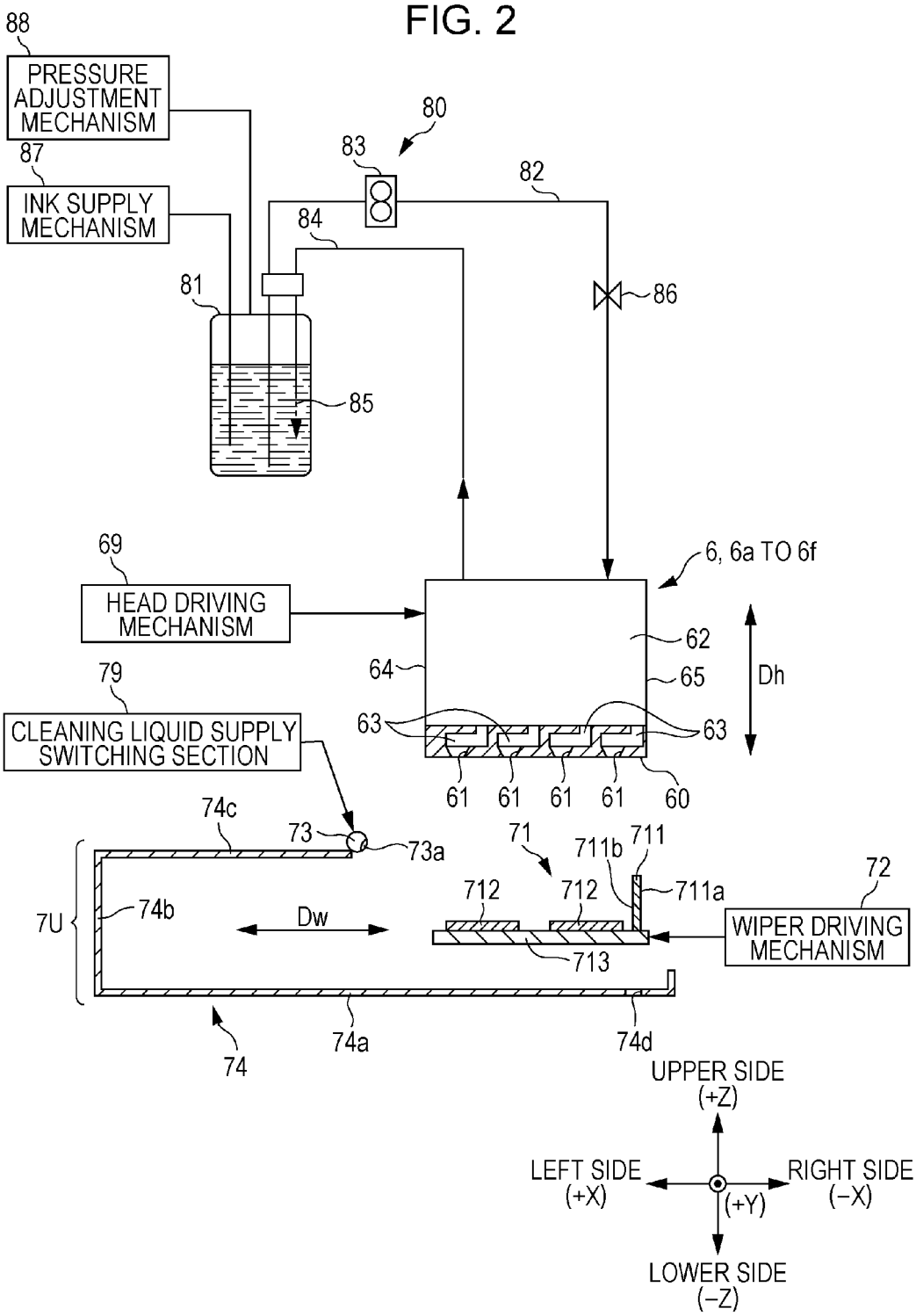
FIG. 2 is a schematic diagram illustrating an example of the configuration of a maintenance system.

However, maintenance systems, which respectively perform maintenance for the printing heads 6*a* to 6*f*, are provided in the printer 1. FIG. 2 is a schematic diagram illustrating an example of the configuration of the maintenance system. Meanwhile, since the printing heads 6*a* to 6*f* respectively have the same configuration, hereinafter, any one of the printing heads 6*a* to 6*f* is expressed as a printing head 6 without distinguishing between the printing heads 6*a* to 6*f*, and maintenance performed on the printing head 6 will be described. Meanwhile, hereinafter, for convenience, a case in which a nozzle forming surface 60 is approximately horizontal as illustrated in FIG. 2 will be described.

A maintenance unit 7U, which is provided in the maintenance system, is arranged for each printing head 6 one by one, and performs maintenance, such as wiping and capping, on the printing head 6. The maintenance unit 7U is provided to be adjacent to the platen drum 30 in the Y direction. In contrast, the printing head 6 freely moves in the Y direction between the upper part printing location of the platen drum 30 and the upper part maintenance location of the maintenance unit 7U by a head driving mechanism 69. Further, the printing head 6 freely moves in the exit direction Dh, which is perpendicular to the nozzle forming surface 60, by the head driving mechanism 69 such that it is possible to acquire a cleaning location which is close to the maintenance unit 7U and a retreat location which is separated from the maintenance unit 7U in the maintenance location. Further, when maintenance is performed, the printing head 6 appropriately moves in the exit direction Dh according to a maintenance process.

The printing head 6 includes nozzles 61 which are open on the nozzle forming surface 60, a reservoir 62 which temporarily stores ink, and cavities 63 through which the nozzles 61 with the reservoir 62 communicate. Ink is supplied from the reservoir 62 to the nozzles 61 through the cavities 63. Further, when the cavities 63 apply pressure to ink according to an operational instruction from a control unit 100 (FIG. 3A), ink is discharged from the nozzles 61. In addition, an ink circulation mechanism 80 is provided for the printing head 6. The speed and pressure of ink, which is circulated between the tank 81 for storing ink and the reservoir 62 of the printing head 6, is adjusted by the ink circulation mechanism 80.

The ink circulation mechanism 80 causes ink to be circulated between the tank 81 for storing ink and the printing head 6. In order to perform an ink circulation function, the ink circulation mechanism 80 further includes a supply channel (supply pipe) 82 which connects the reservoir 62 to the tank 81, a circulation pump 83 which is provided in the supply channel 82, and a collection channel (collection pipe) 84 which connects the reservoir 62 to the tank 81, in addition to the tank 81. The tank 81, the supply channel 82, the reservoir 62, and the collection channel 84 form a circulation path 85 through which ink flows. When the circulation pump 83 rotates in a forward direction, ink is circulated through the circulation path 85. That is, when the circulation pump 83 is rotated in the forward direction, it is possible to supply ink from the tank 81 to the reservoir 62 through the supply channel (forward path) 82, and it is possible to collect ink from the reservoir 62 to the tank 81 through the collection channel (reverse path) 84. In addition, it is possible to change an ink circulation speed by controlling the number of repetitions of the operation of the circulation pump 83. In the embodiment, it is possible to switch between a circulation speed (hereinafter, referred to as a "first speed"), which is acquired when a printing operation in which an image is printed on the sheet S, and a circulation speed (hereinafter, referred to as a "second speed") which is faster than the first speed. The second speed is a circulation speed which is acquired when maintenance is performed by a maintenance unit which will be described later.

In addition, the ink circulation mechanism 80 includes a valve 86 which opens and closes the supply channel 82. The valve 86 is provided in the middle of a way that reaches the reservoir 62 from the circulation pump 83 along the circulation path 85. Therefore, it is possible to supply ink from the tank 81 to the reservoir 62 by opening the valve 86, and it is possible to stop supplying ink from the tank 81 to the reservoir 62 by closing the valve 86.

Further, the ink circulation mechanism 80 includes an ink supply mechanism 87 which supplies ink to the tank 81, and a pressure adjustment mechanism 88 which adjusts pressure in the tank 81. The ink supply mechanism 87 includes an ink cartridge and an ink pack, and supplies ink to the tank 81 from the ink cartridge and the ink pack. That is, ink which is supplied to the tank 81 has, for example, a viscosity of 15 mPa/S at the temperature between 28° C. and 40° C. In addition, the pressure adjustment mechanism 88 includes a pump which is connected to the tank 81, and adjusts the pressure in the tank 81 by rotating the pump. Accordingly, it is possible to respectively adjust the pressure in the tank 81 to negative pressure, atmospheric pressure, and positive pressure. Meanwhile, although description is omitted above, the maintenance unit 7U, which maintains the nozzles 61 of the printing head 6, is provided. The maintenance unit 7U is provided to be adjacent to the platen drum 30 in the Y direction. Each printing head 6 freely moves between the upper part of the platen drum 30 and the upper part of the maintenance unit 7U in the Y direction. When the printing operation is performed, the printing head 6 is located at the upper part of the platen drum 30. In contrast, when maintenance is performed, the printing head 6 is located at the upper part of the maintenance unit 7U.

The maintenance unit 7U includes a movement body 71 which has a wiper 711, caps 712 and a support member 713 for supporting the wiper 711 and the caps 712 such that the wiper 711 and the caps 712 can integrally move, a wiper driving mechanism 72 which causes the movement body 71 to move in a wiping direction Dw along the nozzle forming surface 60, a cleaning liquid supply pipe 73 which ejects cleaning liquid from an ejection port 73*a*, and a housing 74. Each of the members has a Y directional length which is equal to or longer than that of the printing head 6, and it is possible to perform maintenance on the whole nozzle forming surface 60. Further, wiping is performed in such a way that the wiper 711 moves in the wiping direction Dw in a state in which the wiping surface 711*a* or 711*b* comes into contact with the nozzle forming surface 60. In addition, capping is performed in such a way that the caps 712 adhere to the nozzle forming surface 60 so as to cover the entirety of the nozzles 61.

The cleaning liquid supply pipe 73 includes a plurality of ejection ports 73*a*, which are open toward the side of the printing head 6, in the Y direction, and is capable of ejecting the cleaning liquid to an ink-supplied surface 64, which is a side surface of the side of the cleaning liquid supply pipe 73 of the printing head 6 when the printing head 6 is located at a cleaning location which is close to the maintenance unit 7U. Here, it is possible to appropriately use liquid, which is suitable for cleaning action, as the cleaning liquid which is provided for wiping. However, when UV ink is used as in the embodiment, it is preferable to use a solvent which is capable of dissolving hardened UV ink. For example, Ethyldiglycolacetate (EDGAC), transparent UV ink, or the like may be provided as such a solvent. In addition, a solvent, to which a surfactant or a polymerization inhibitor is added, may be used as the cleaning liquid. Meanwhile, the switching of the supply of the cleaning liquid performed by the cleaning liquid supply pipe 73 is performed by a cleaning liquid supply switching section 79.

The housing 74 mainly includes a bottom surface section 74*a* which is approximately parallel in the wiping direction Dw, a side wall section 74*b* which is installed from the one end of the bottom surface section 74*a* in the wiping direction Dw, and an eave section 74*c* which extends in the same side as the bottom surface section 74*a* from the upper end of the side wall section 74*b* along the wiping direction Dw. The bottom surface section 74*a* is provided over a range, which is slightly wider than a range in which the movement body 71 can move, in the wiping direction Dw, and receives waste liquid which includes ink or cleaning liquid that are generated when maintenance is performed. The waste liquid, which is received in the bottom surface section 74*a*, is emitted from the maintenance unit 7U through an emission port 74*d* which is formed in the bottom surface section 74*a*. The eave section 74*c* has a larger dimension in the wiping direction Dw than that of the movement body 71. Further, when the printing operation is performed, the movement body 71 maintains a state in which the movement body 71 is covered by the eave section 74*c* in a stand-by location which is the lower part of the eave section 74*c*. In this manner, the eave section 74*c* shades the light (ultraviolet) which is irradiated from the UV lamps 37*a*, 37*b*, and 38, and prevents the UV ink which adheres to the wiper 711 or the caps 712 from hardening.

FIG. 3A is a block diagram illustrating an example of an electrical configuration of the maintenance system, FIG. 3B is a table illustrating an example of data which indicates the relationship between a printing time and the number of repetitions of the combined head cleaning operation. In the maintenance system, which is configured as described above, an operation is controlled by the control unit 100 which is provided in the printer 1. For example, when the control unit 100 controls the head driving mechanism 69, the printing head 6 is appropriately arranged at each location such as the cleaning location or the retreat location. In addition, when the control unit 100 controls the wiper driving mechanism 72, the movement body 71 is driven, and thus the wiper 711 and the caps 712 perform operations according to a maintenance process. In addition, when the control unit 100 controls the cleaning liquid supply switching section 79, states switch between a state in which the cleaning liquid is ejected from the ejection port 73*a* of the cleaning liquid supply pipe 73 and a state in which the cleaning liquid is not ejected from the ejection port 73*a* of the cleaning liquid supply pipe 73. In addition, the control unit 100 stores data, which indicates the relationship between the printing time and the number of repetitions of the combined head cleaning operation for each ink color, in the form of a table in a storage section, which is not shown in the drawing, in advance. That is, a count table 101, which includes the data, is stored in the storage section in advance. Further, when the ink circulation mechanism 80 is controlled as will be subsequently described, a circulation speed of ink which is supplied to the printing head 6 switches between the first speed and the second speed, and the number of repetitions of a reciprocative cleaning process (step S4 which will be described later) according to the printing time switches.

Figure 4:
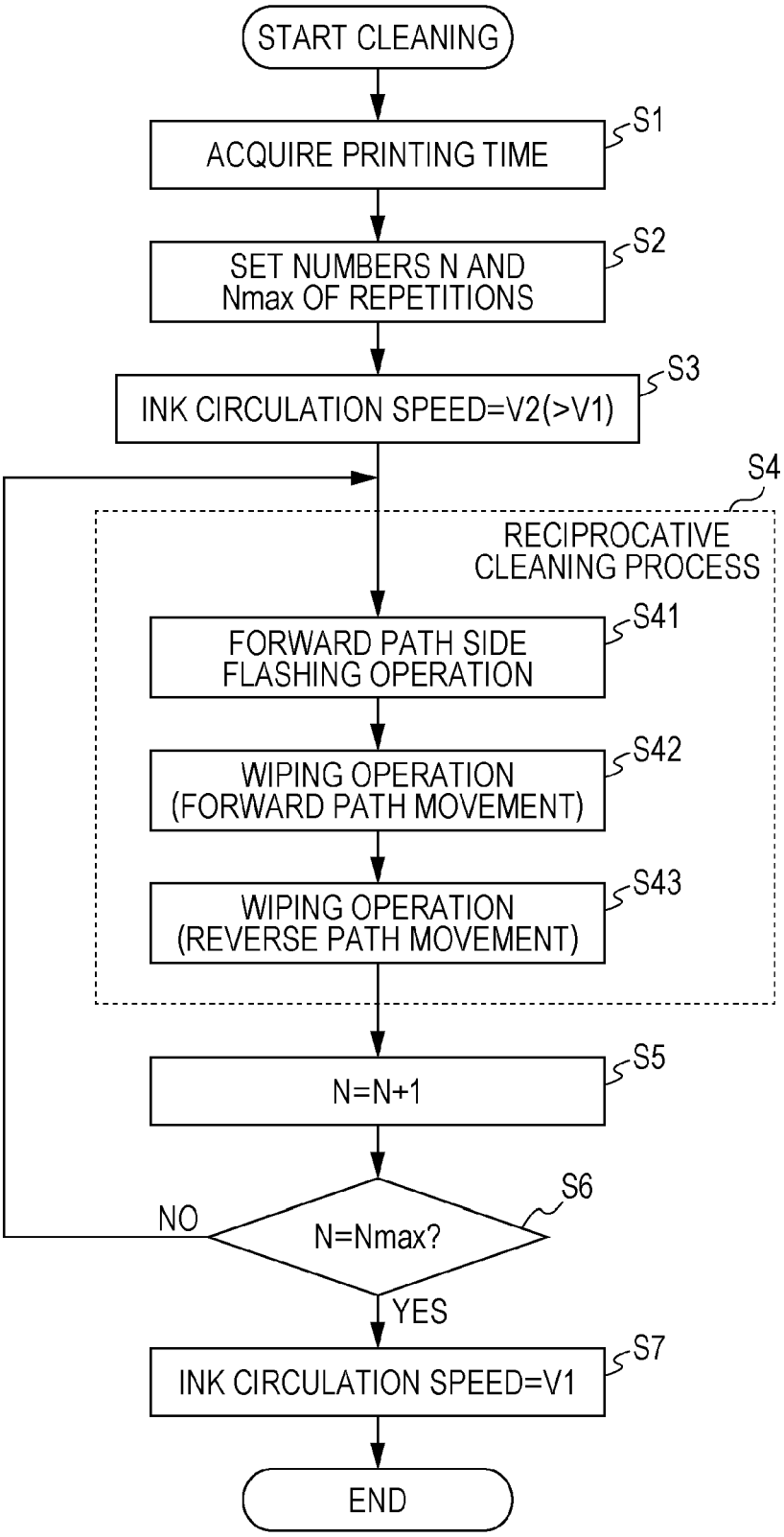
FIG. 4 is a flowchart illustrating the flow of the maintenance.
Figure 5A:
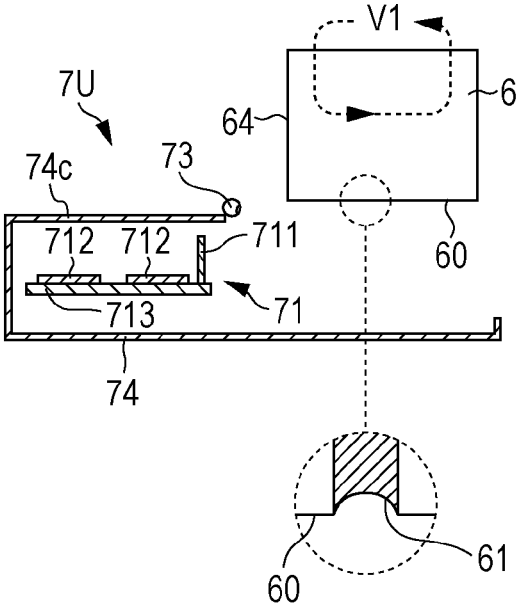
FIGS. 5A and 5B are schematic diagrams illustrating an ink circulation operation.
Figure 5B:
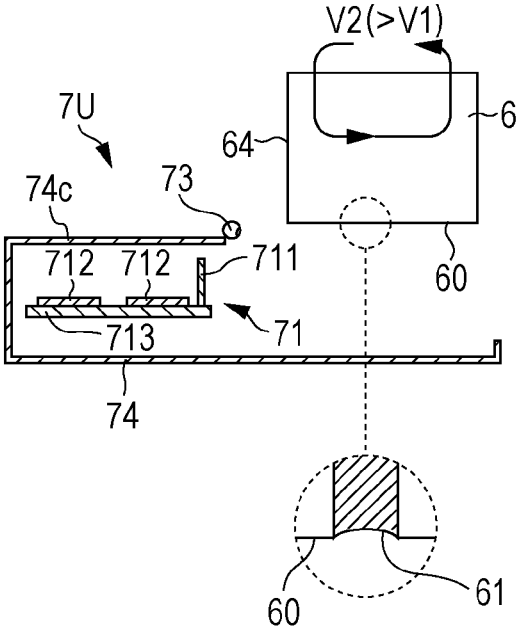
Figure 6A:
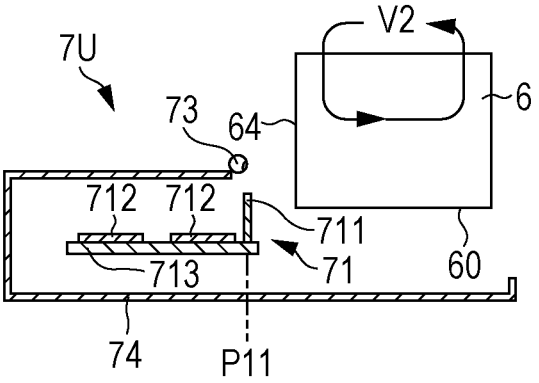
FIGS. 6A and 6B are schematic diagrams illustrating a forward path side flashing operation.
Figure 6B:
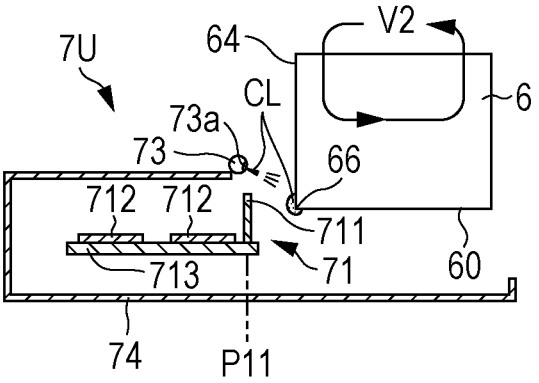

Subsequently, the flow of maintenance, which is performed on the printing head 6 using the maintenance unit 7U, will be described. FIG. 4 is a flowchart illustrating the flow of maintenance, FIGS. 5A and 5B are schematic diagrams illustrating an ink circulation operation, FIGS. 6A and 6B are schematic diagrams illustrating a forward path side flashing operation, FIGS. 7A to 7D are schematic diagrams illustrating a forward path side wiping operation, and FIGS. 8A to 8E are diagrams illustrating a reverse path side wiping operation. When maintenance is performed by the maintenance unit 7U, first, the control unit 100 acquires the printing time (step S1). The printing time means time which is taken when a printing process is performed until the current time from after previous maintenance. The printing time is acquired by taking into consideration that the amount of adhesion of ink or foreign substances to the nozzle forming surface 60 increases according to the increase in the printing time.

Further, in subsequent step S2, the control unit 100 initially sets the number of repetitions of the reciprocative cleaning process. More specifically, the actual number N of repetitions is reset to 0 and the number Nmax of repetitions corresponding to the printing time which is acquired in step S1 is read from the count table 101. For example, when the printing head 6 which is a maintenance target is clear ink (Dv) and the printing time which is acquired in step S1 is "12 minutes", the number Nmax of repetitions is "5 times", and preparation for repeating a reciprocative cleaning process, which will be described later, is completed five times.

Before the reciprocative cleaning process is performed, a process of increasing the ink circulation speed is performed (step S3). While the printing process is performed, ink is circulated at a normal speed (first speed V1) along the circulation path 85 (FIG. 2) and back pressure for a liquid surface in the nozzles switches to negative pressure which is lower than atmospheric pressure, as illustrated in FIG. 5A. In contrast, when the reciprocative cleaning process is performed the control unit 100 switches the back pressure into positive pressure which is higher than atmospheric pressure by increasing the number of repetitions of the operation of the circulation pump 83 rather than a case of normal printing and increasing the circulation speed to the second speed V2 which is faster than the normal speed V1, as illustrated in FIG. 5B. Meanwhile, areas, which are expressed by dotted lines in FIGS. 5A and 5B, schematically illustrate ink states in the vicinity of the nozzle 61. As illustrated in the drawings, when the second speed V2 is increased, the liquid surface of ink forms meniscus in a state which is slightly recessed from the opening of the nozzle and thus the foreign substances are prevented from entering the inside of the nozzle.

When the preparation of the reciprocative cleaning process (step S4) is completed in this manner, the control unit 100 performs combined head cleaning for the printing head 6 by controlling each of the sections of the device as below. Meanwhile, in the description below, when the process of increasing the speed is performed (step S3), a side on which the wiper 711 is in a standby position under the eave section 74*c* (left hand side in FIG. 2 and FIGS. 5A and 5B) is called a "forward path side", and an opposite side (right hand side in FIG. 2 and FIGS. 5A and 5B) is called a "reverse path side". In addition, the movement of the wiper 711 from the forward path side to the reverse path side is called "forward path movement", and the movement of the wiper 711 from the reverse path side to the forward path side is called "reverse path movement". A forward path movement direction corresponds to a "first direction" of the invention, and a reverse path movement direction corresponds to a "second direction" of the invention.

Immediately before the reciprocative cleaning process starts, the printing head 6 is located in a retreated location which is separated from the maintenance unit 7U and the wiper 711 (movement body 71) is located in a stand-by location at the lower part of the eave section 74*c* as illustrated in FIG. 5B. When the reciprocative cleaning process starts, first, the forward path side flashing operation is performed (step S41). That is, the wiper driving mechanism 72 moves the wiper 711 to the starting location P11 and the head driving mechanism 69 moves the printing head 6 to the cleaning location, which is close to the maintenance unit 7U, according to the operational instruction from the control unit 100, as illustrated in FIG. 6A. As a result, the tip of the wiper 711 is in a state in which the tip of the wiper 711 faces the forward path side ink-supplied surface 64 of the printing head 6, in other words, in state in which parts of the wiper 711 and the ink-supplied surface 64 overlap each other in the exit direction Dh (vertical direction in the drawing).

Subsequently, when the control unit 100 issues an operational instruction to the cleaning liquid supply switching section 79 in order to supply the cleaning liquid, the cleaning liquid is ejected from the ejection port 73*a* of the cleaning liquid supply pipe 73 to the forward path side ink-supplied surface 64 of the printing head 6 as illustrated in FIG. 6B. The cleaning liquid, which is ejected from the ejection port 73*a*, passes through the upper part of the wiper 711, and lands on the ink-supplied surface 64 without landing on the wiper 711. When the cleaning liquid is ejected to the ink-supplied surface 64, the cleaning liquid CL, which adheres to the ink-supplied surface 64, flows to the lower part along the ink-supplied surface 64 and accumulates in the corner section 66 between the ink-supplied surface 64 and the nozzle forming surface 60. In this manner, the forward path side flashing operation is completed (step S41).

Figure 7A:
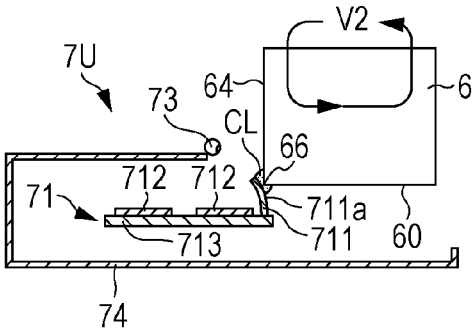
FIGS. 7A to 7D are schematic diagrams illustrating a forward path side wiping operation.

When a sufficient amount of cleaning liquid is supplied for head cleaning, the ejection of the cleaning liquid stops, and wiping is performed by causing the wiper 711 to perform forward path movement from the starting location P11 to a stop location P12 (step S42). In this process, the wiping surface 711*a* of the wiper 711 comes into contact with the corner section 66, the cleaning liquid CL, which accumulate in the corner section 66, are maintained by the wiper 711 in the form in which the cleaning liquid CL are interposed between the wiping surface 711*a* and the nozzle forming surface 60, as illustrated in FIG. 7A. Further, wiping is performed while the cleaning liquid CL, which is maintained by the wiper 711, is spread on the nozzle forming surface 60.

Figure 7B:
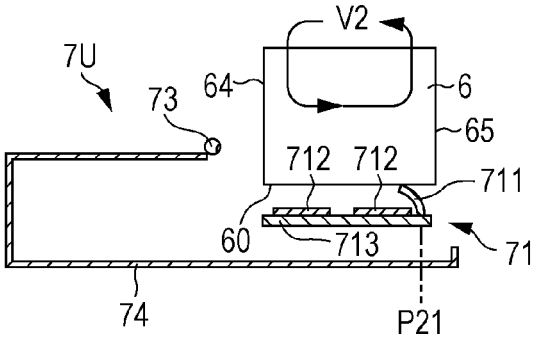

FIG. 7B illustrates a state in which the wiper 711 is moved to the stop location P12. In the forward path movement of the wiper 711, the stop location P12 is located at the lower part of the printing head 6. As above, the reason that the location of the stop location P12 is set to the lower part of the printing head 6 is as follows. When the wiper 711 is moved to the opposite side of the ink-supplied surface 64, that is, the reverse path side (right side in the drawing) rather than the side surface 65 on the reverse path side, the following problems occur. That is, when the wiper 711 passes and returns to an original standing posture, there is a case in which foreign substances and ink, which adhere to the wiper 711 due to the elasticity force of the wiper 711, are scattered around. In addition, there is a case in which foreign substances and ink scraped by the wiper 711 and remaining on the wiping surface 711*a*, adhere to the side surface 65 on the reverse path side. In order to solve the above problems, the lower part of the printing head 6 is set as the location of the stop location P12 and thus the contact between the wiping surface 711*b* and the side surface 65 is prevented, thereby realizing excellent wiping.

Figure 7C:
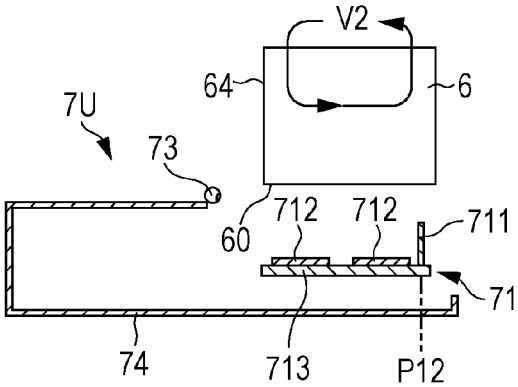
Figure 7D:
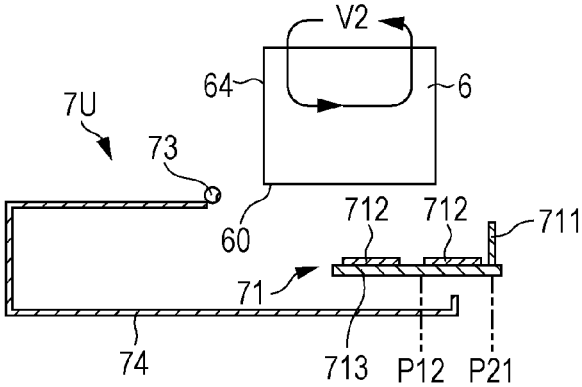

Subsequently, as illustrated in FIG. 7C, the printing head 6 is moved one time to the retreated location. Accordingly, a state in which the wiper 711, which is located in the stop location P12, is bent on the left side is resolved (FIG. 7C). The wiper 711 is moved to a starting location P21 in subsequent reverse path movement while the printing head 6 is located in the retreated location (FIG. 7D). The starting location P21 is located on the reverse path side rather than the stop location P12.

Figure 8A:
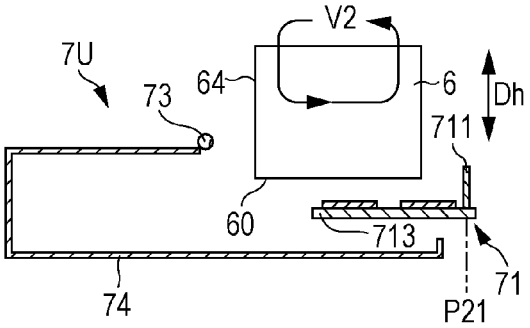
FIGS. 8A to 8E are schematic diagrams illustrating a reverse path side wiping operation.

When preparation of the reverse path movement is completed in this manner, the head driving mechanism 69 causes the printing head 6 to move the cleaning location which is close to the maintenance unit 7U. As a result, as illustrated in FIG. 8A, the tip of the wiper 711 is in a state in which the tip of the wiper 711 faces the head side surface 65 on the reverse path side of the printing head 6, in other words, in state in which parts of the wiper 711 and the head side surface 65 overlap each other in the exit direction Dh (vertical direction in the drawing).

Figure 8B:
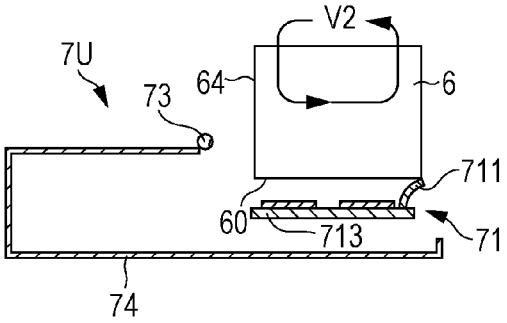

Subsequently, wiping is performed by causing the wiper 711 to perform reverse path movement from the starting location P21 to a stop location P22 (step S43). In this process, as illustrated in FIG. 8B, the wiping surface 711*b* of the wiper 711 comes into contact with the corner section 67, and wiping is performed on the nozzle forming surface 60 due to the reverse path movement of the wiper 711.

Figure 8C:
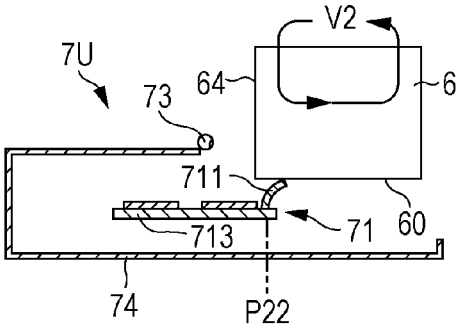

FIG. 8C illustrates a state in which the wiper 711 is moved to the stop location P22 in the reverse path movement. The stop location P22 is located at the lower part of the printing head 6. The stop location P22 includes the same technical meaning as the stop location P12 in the forward path movement. That is, when the wiper 711 is moved to the forward path side (left side in the drawing) rather than the ink-supplied surface 64, there is a problem in that scattering of foreign substances due to the elasticity force of the wiper 711 or the adhesion of foreign substances, which remain on the wiping surface 711*b*, to the ink-supplied surface 64 may occur. Here, similar to the forward path side wiping operation (step S42), when the lower part of the printing head 6 is set as the location of the stop location P22, the contact between the wiping surface 711*a* and the side surface 64 is avoided, thereby realizing excellent wiping.

Figure 8D:
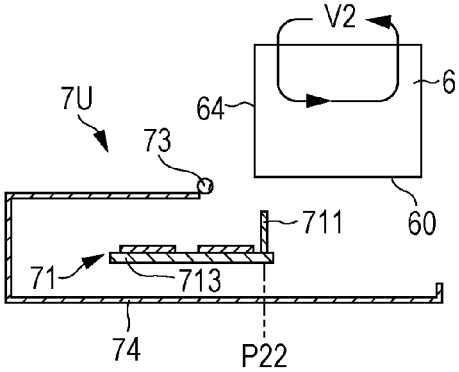
Figure 8E:
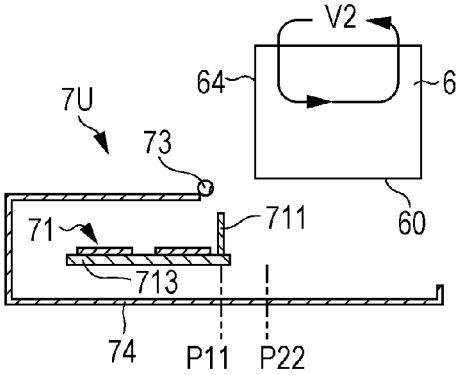

Subsequently, as illustrated in FIG. 8D, the printing head 6 is moved one time to the retreated location. Accordingly, a state in which the wiper 711, which is located in the stop location P22, is bent on the right side is resolved. In addition, the wiper 711 is moved to the starting location P11 in the forward path movement while the printing head 6 is located in the retreated location. In this manner, the reciprocative cleaning process, which includes the forward path side flashing operation (step S41), the wiping operation which is performed while causing the wiper 711 to perform the forward path movement (step S42) and the wiping operation which is performed while causing the wiper 711 to perform reverse path movement (step S43), is completed one time.

Here, after the control unit 100 increases the count value of the number N of repetitions by "1" (step S5), and the control unit 100 determines whether or not the number N of repetitions reaches the number Nmax of repetitions corresponding to the printing time (step S6). When it is determined to be "NO" in step S6, the process returns to step S41, and the reciprocative cleaning process (step S4) is repeated. In contrast, when the cleaning of the printing head 6 is completed in such a way that the reciprocative cleaning process corresponding to the number N of repetitions is performed as many times as the number Nmax of repetitions, the control unit 100 causes the wiper 711 to move to the forward path side (left side) rather than the starting location P11 in the forward path movement, and returns the back pressure for the liquid surface in the nozzle to negative pressure, which is lower than atmospheric pressure, by reducing the ink circulation speed from the second speed V2 to the normal speed (first speed) V1, thereby preparing a subsequent printing process, as illustrated in FIG. 5A.

As described above, in the embodiment, the ink circulation speed is increased to the second speed V2, which is faster than the normal speed (circulation speed V1 acquired when ink is discharged in order to perform the printing process) during the combined head cleaning operation, and thus the back pressure of the nozzles during the combined head cleaning operation, which is performed in the reciprocative cleaning process, becomes positive pressure which is higher than atmospheric pressure. Therefore, it is possible to effectively prevent foreign substances, which are left from the nozzle forming surface 60, from entering the nozzles 61.

In addition, it is possible to perform the combined head cleaning on both the forward path side and the reverse path side while causing the wiper 711 to perform reciprocating movement, and it is possible to increase cleaning effect due to the combined head cleaning.

In addition, the amount of adhesion of foreign substances and ink to the nozzle forming surface 60 increases in proportion to the printing time, that is, time in which ink is discharged from the nozzles. Here, in the embodiment, the number Nmax of repetitions of the reciprocative cleaning process is adjusted according to the printing time. Therefore, cleaning is performed according to the amount of adhesion of foreign substances and ink to the nozzle forming surface 60, with the result that excessive use of the cleaning liquid is prevented, and thus it is possible to reduce running costs.

Second Embodiment

Figure 9:
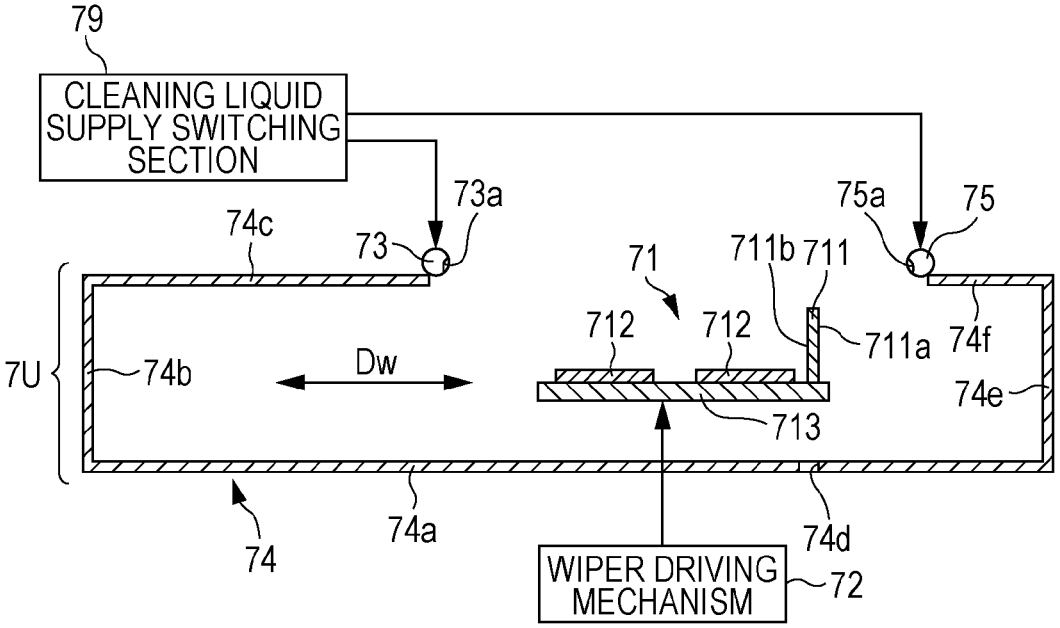
FIG. 9 is a diagram illustrating the main configuration of a liquid discharge device according to a second embodiment of the invention.
Figure 10:
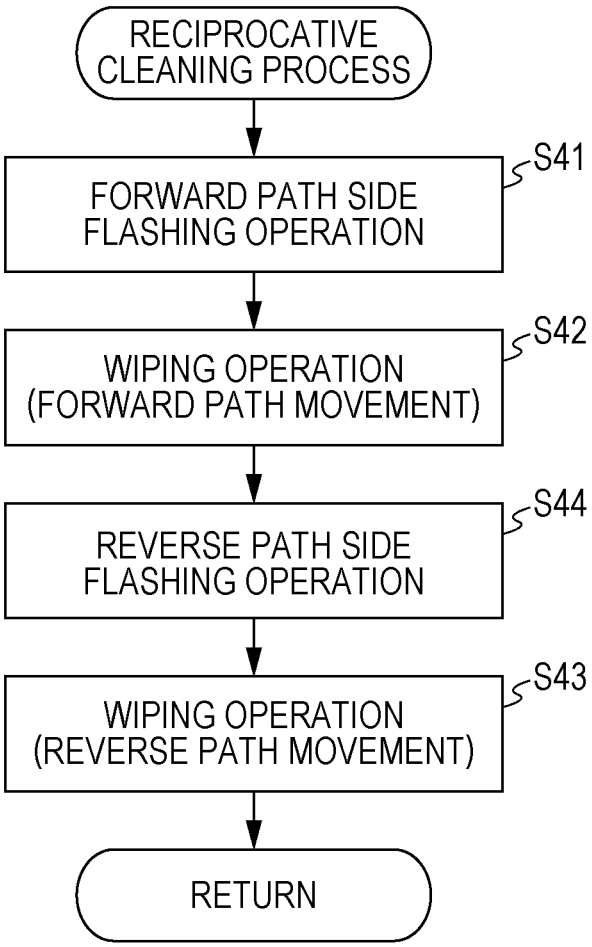
FIG. 10 is a flowchart illustrating a reciprocative cleaning process according to the second embodiment.
Figure 11A:
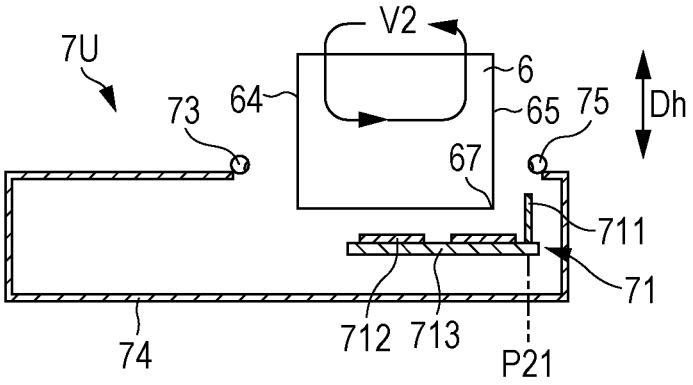
FIGS. 11A and 11B are diagrams schematically illustrating a reverse path side flashing operation according to the second embodiment.
Figure 11B:
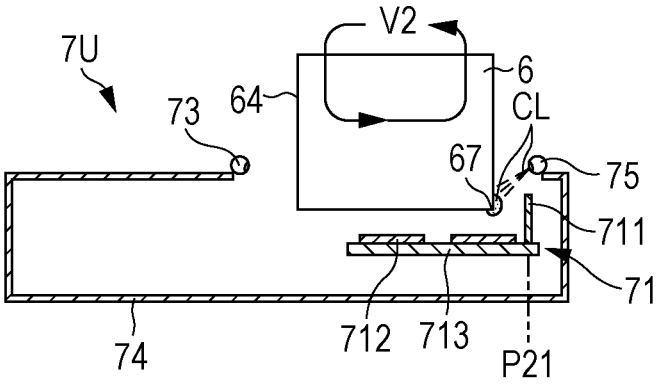

FIG. 9 is a diagram illustrating the main configuration of a liquid discharge device according to a second embodiment of the invention. In addition, FIG. 10 is a flowchart illustrating a reciprocative cleaning process according to the second embodiment. Further, FIGS. 11A and 11B are diagrams schematically illustrating a reverse path side flashing operation according to the second embodiment. The second embodiment is greatly different from the first embodiment in that the flashing operation is performed on not only the forward path side but also the reverse path side, and the other configurations and operations are the same as in the first embodiment. Therefore, hereinafter, description will be performed centering on the difference, the same reference symbols are attached to the same configurations and operations, and the description thereof will not be repeated.

In the second embodiment, an eave section 74*f*, which extends on the same side as the bottom surface section 74*a*, is provided from the upper end of the side wall section 74*e* of the reverse path side along the wiping direction Dw on not only the forward path side but also the reverse path side, as illustrated in FIG. 9. In addition, the cleaning liquid supply pipe 75 is provided at the tip of the eave section 74*f*. The cleaning liquid supply pipe 75 is connected to the cleaning liquid supply switching section 79, and is capable of ejecting the cleaning liquid from the ejection port 75*a* of the cleaning liquid supply pipe 75 toward the reverse path side ink-supplied surface 65 of the printing head 6 at a timing which is different from the timing in which the cleaning liquid is supplied to the cleaning liquid supply pipe 73.

Further, when maintenance is performed on the printing head 6 using the maintenance unit 7U, a reciprocative cleaning process is prepared in the same manner as in the first embodiment. That is, the control unit 100 acquires the printing time (step S1), sets the number Nmax of repetitions corresponding to the printing time based on the count table 101, and resets the number N of repetitions to 0 (step S2). Further, the control unit 100 switches the back pressure to the positive pressure which is higher than atmospheric pressure by increasing the circulation speed to the second speed V2.

When the preparation of the reciprocative cleaning process (step S4) is completed in this manner, the control unit 100 sequentially performs the forward path side flashing operation (step S41), and the wiping operation while causing the wiper 711 to perform the forward path movement (step S42) by controlling each of the sections of the device, as illustrated in FIG. 10. Subsequent to the forward path side wiping operation, the reverse path side flashing operation is performed (step S44). That is, at the time in which the forward path side wiping operation is completed, the location of the wiper 711 is determined to be the starting location P21 in the reverse path movement and the printing head 6 is located in the retreat location, as illustrated in FIG. 7D. Here, in the reverse path side flashing operation, first, the head driving mechanism 69 causes the printing head 6 to move to the cleaning location which is close to the maintenance unit 7U. As a result, as illustrated in FIG. 11A, a state is acquired in which the tip of the wiper 711 faces the reverse path side ink-supplied surface 65 of the printing head 6, in other words, a state is acquired in which parts of the wiper 711 and the head side surface 65 overlap with each other in the exit direction Dh (vertical direction in the drawing).

Subsequently, when the control unit 100 issues an operational instruction to the cleaning liquid supply switching section 79 in order to supply the cleaning liquid to the cleaning liquid supply pipe 75, the cleaning liquid CL is ejected from the ejection port 75*a* of the cleaning liquid supply pipe 75 to the reverse path side ink-supplied surface 65 of the printing head 6, as illustrated in FIG. 11B. The cleaning liquid, which is ejected from the ejection port 75*a*, passes through the upper part of the upper part of the wiper 711, and lands on the ink-supplied surface 65 without landing on the wiper 711. When the cleaning liquid CL is ejected to the ink-supplied surface 65, the cleaning liquid CL, which adheres to the ink-supplied surface 65, flows to the lower part along the ink-supplied surface 65, and accumulates in the corner section 67 between the ink-supplied surface 65 and the nozzle forming surface 60. In this manner, when a sufficient amount of cleaning liquid is supplied for the head cleaning, the ejection of the cleaning liquid stops, and the reverse path side flashing operation is completed (step S44).

Further, wiping is performed by causing the wiper 711 to perform reverse path movement from the starting location P21 to the stop location P22 (step S43). In this process, similarly to the forward path wiping operation (step S42), the wiping surface 711*b* of the wiper 711 comes into contact with the corner section 67, the cleaning liquid CL, which accumulates in the corner section 67, is maintained by the wiper 711 in the form in which the cleaning liquid CL is interposed between the wiping surface 711*b* and the nozzle forming surface 60. Further, wiping is performed while the cleaning liquid CL, which is maintained by the wiper 711, is spread on the nozzle forming surface 60 (step S43). In this manner, a reciprocative cleaning process, which includes the forward path side flashing operation (step S41), the wiping operation that is performed while causing the wiper 711 to perform the forward path movement (step S42), the reverse path side flashing operation (step S44), and the wiping operation that is performed while causing the wiper 711 to perform the reverse path movement (step S43), is completed one time.

Further, similarly to the first embodiment, after the reciprocative cleaning process (step S4) corresponding to the number Nmax of repetitions is performed, the wiper 711 is moved to the forward path side (left side) rather than the starting location P11 in the forward path movement, the ink circulation speed is reduced from the second speed V2 to the normal speed (first speed) V1, and thus the back pressure for the liquid surface in the nozzle returns to the negative pressure which is lower than atmospheric pressure.

As described above, in the second embodiment, the flashing operation is performed on not only the forward path side but also the reverse path side, with the result that the cleaning liquid is rich when both the combined head cleaning on the forward path side and the combined head cleaning on the reverse path side are performed, and thus it is possible to further enhance the cleaning effects.

Third Embodiment

Figure 12:
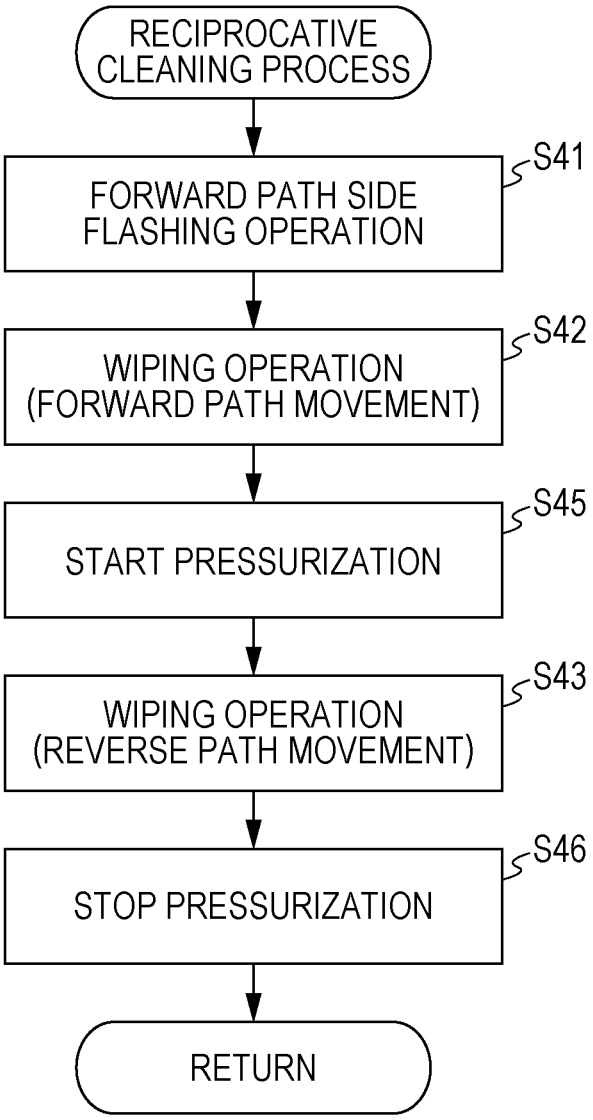
FIG. 12 is a flowchart illustrating a reciprocative cleaning process according to a third embodiment.
Figure 13A:
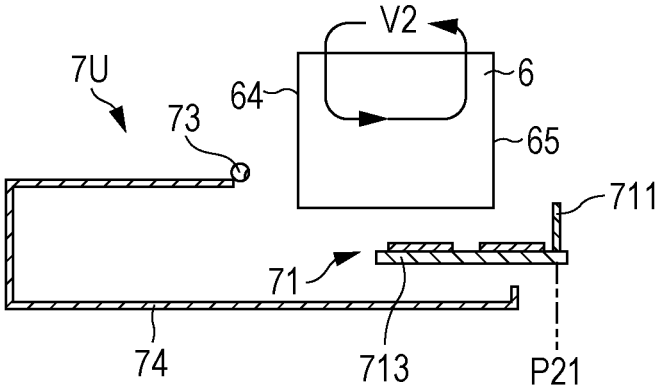
FIGS. 13A and 13B are diagrams schematically illustrating a reverse path side pressurization operation according to the third embodiment.
Figure 13B:
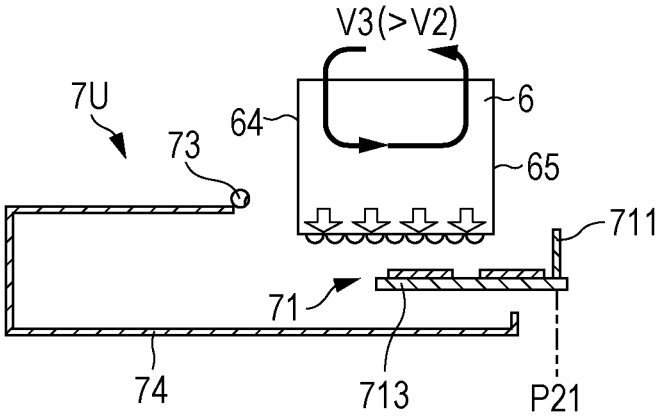

FIG. 12 is a flowchart illustrating a reciprocative cleaning process according to a third embodiment. In addition, FIGS. 13A and 13B are diagrams schematically illustrating a reverse path side pressurization operation according to the third embodiment. The third embodiment is greatly different from the first embodiment in that the pressurization operation is performed to correspond to the wiping operation on the reverse path side, and the other configurations and operations are the same as in the first embodiment. Therefore, hereinafter, description will be performed centering on the difference, the same reference symbols are attached to the same configurations and operations, and the description thereof will not be repeated.

In the third embodiment, when maintenance is performed on the printing head 6 using the maintenance unit 7U, the preparation of the reciprocative cleaning process is performed similarly to the first embodiment. That is, the control unit 100 acquires printing time (step S1), sets the number Nmax of repetitions corresponding to the printing time based on the count table 101, and resets the number N of repetitions to 0 (step S2). Further, the control unit 100 switches the back pressure to positive pressure which is higher than atmospheric pressure by increasing the circulation speed to the second speed.

When the preparation of the reciprocative cleaning process (step S4) is completed in this manner, the control unit 100 controls each of the sections of the device such that the forward path side flashing operation (step S41) and the wiping operation (step S42), which is performed while causing the wiper 711 to perform the forward path movement, are sequentially performed, as illustrated in FIG. 12. At the point of time in which the forward path side wiping operation is completed, the location of the wiper 711 is determined to be the starting location P21 in the reverse path movement, and the printing head 6 is located in the retreat location, as illustrated in FIG. 7D. Here, as illustrated in FIG. 13A, after the head driving mechanism 69 causes the printing head 6 to move to the cleaning location which is close to the maintenance unit 7U, the control unit 100 starts ink pressurization by further increasing the circulation speed from the second speed V2 to a third speed V3 (>V2) (step S45). Therefore, as illustrated in FIG. 13B, ink drops from each of the nozzles 61 (refer to FIG. 2). Further, wiping is performed by causing the wiper 711 to perform the reverse path movement from the starting location P21 to the stop location P22 while the pressurization state is maintained (step S43). In this process, foreign substances are wiped together with ink which drops from each of the nozzles 61. When the reverse path side wiping operation is completed, the control unit 100 stops the ink pressurization by returning the circulation speed to the second speed V2 (step S46). In this manner, the reciprocative cleaning process, which includes the forward path side flashing operation (step S41), the wiping operation that is performed while causing the wiper 711 to perform the forward path movement (step S42), ink dropping operation due to the pressurization (step S45) and the wiping operation that is performed while causing the wiper 711 to perform the reverse path movement (step S43), is completed one time.

Further, similarly to the first embodiment, after the reciprocative cleaning process (step S4) corresponding to the number Nmax of repetitions is performed, the wiper 711 is moved to the forward path side (left side) rather than the starting location P11 in the forward path movement, the ink circulation speed is reduced from the second speed V2 to the normal speed (first speed) V1, and thus the back pressure for the liquid surface in the nozzle is returned to the negative pressure which is lower than atmospheric pressure.

As described above, in the third embodiment, the head cleaning is performed through the cleaning liquid and wiping during the forward path movement, and the head cleaning is performed through ink dropping and whipping during the reverse path movement. Since different types of head cleaning are combined and performed as above, it is possible to increase cleaning effects. As above, in the embodiment, the discharge of ink from the nozzles 61 is controlled by controlling pressure which is applied to ink by the ink circulation mechanism 80.

Fourth Embodiment

The combination of the head cleaning which is performed in the third embodiment may be replaced by the forward path side and the reverse path side (fourth embodiment).

Figure 14:
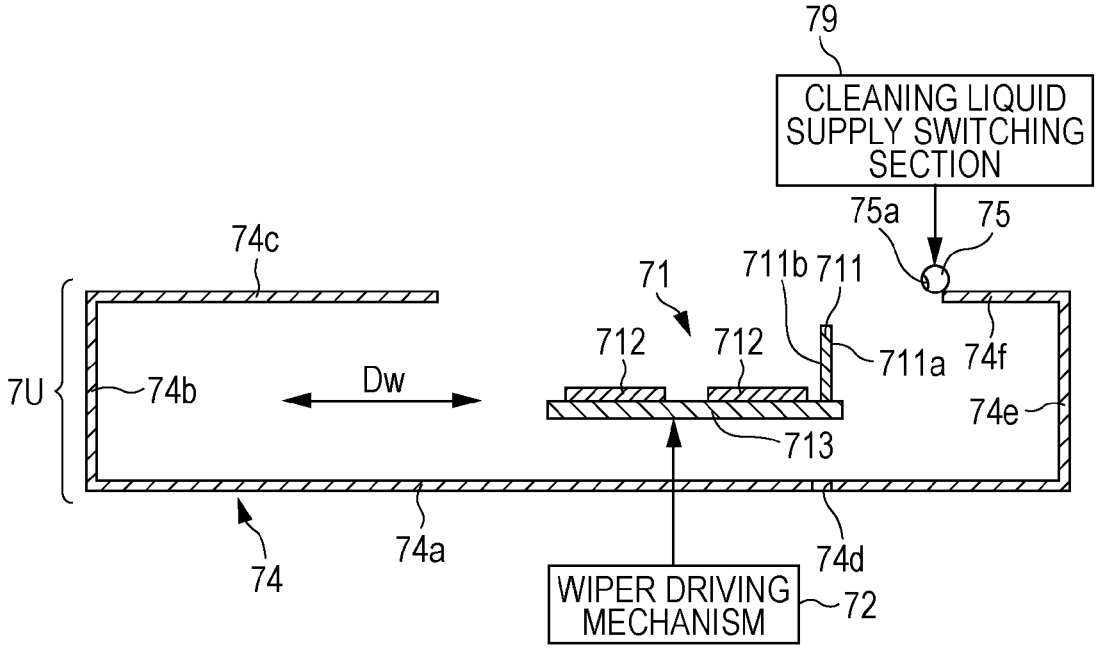
FIG. 14 is a diagram illustrating the main configuration of a liquid discharge device according to a fourth embodiment of the invention.
Figure 15:
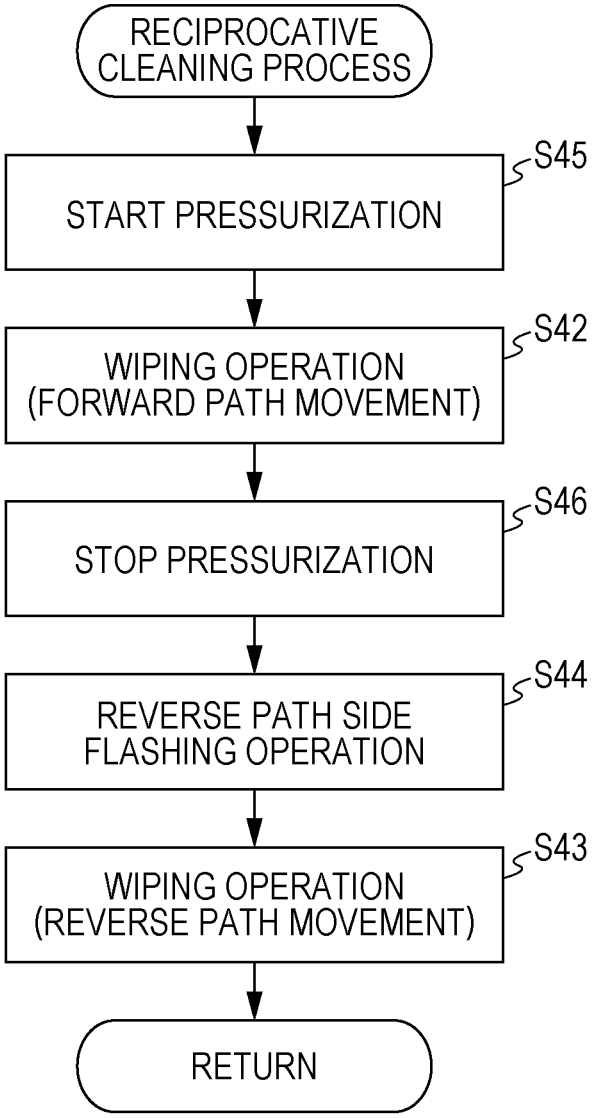
FIG. 15 is a flowchart illustrating a reciprocative cleaning process according to the fourth embodiment.
Figure 16A:
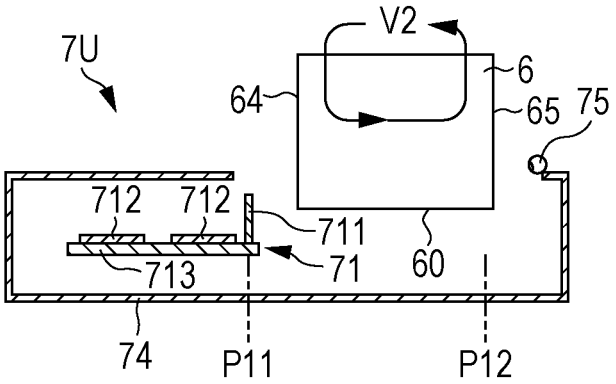
FIGS. 16A and 16B are diagrams schematically illustrating a forward path side pressurization operation according to the fourth embodiment.
Figure 16B:
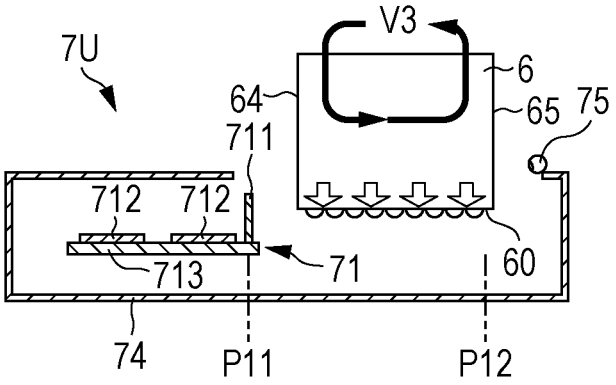

FIG. 14 is a diagram illustrating the main configuration of a liquid discharge device according to a fourth embodiment of the invention. In addition, FIG. 15 is a flowchart illustrating a reciprocative cleaning process according to the fourth embodiment. Further, FIGS. 16A and 16B are diagrams schematically illustrating a forward path side pressurization operation according to the fourth embodiment. The maintenance unit 7U, which is used in the fourth embodiment, has the same configuration as in the second embodiment except whether or not the cleaning liquid supply pipe 73 is present, and is capable of performing the reverse path side flashing operation.

In the fourth embodiment, when the maintenance is performed on the printing head 6 using the maintenance unit 7U, the preparation of the reciprocative cleaning process is performed similarly to the first embodiment. That is, the control unit 100 acquires the printing time (step S1), sets the number Nmax of repetitions corresponding to the print time based on the count table 101, and resets the number N of repetitions to 0 (step S2). Further, the control unit 100 switches the back pressure into the positive pressure which is higher than atmospheric pressure by increasing the circulation speed to the second speed V2.

When the preparation of the reciprocative cleaning process (step S4) is completed in this manner, the head driving mechanism 69 causes the printing head 6 to move to the cleaning location which is close to the maintenance unit 7U, and then the control unit 100 starts ink pressurization by increasing the circulation speed from the second speed V2 to a third speed V3 (step S45), as illustrated in FIG. 16A. Therefore, as illustrated in FIG. 16B, ink drops from each of the nozzles 61 (refer to FIG. 2). Further, wiping is performed by causing the wiper 711 to perform the forward path movement from the starting location P11 to the stop location P12 while the pressurization state is maintained (step S42). Accordingly, foreign substances are wiped together with ink which drops from the nozzles 61. When the forward path side wiping operation is completed, the control unit 100 stops the ink pressurization by returning the circulation speed to the second speed V2 (step S46), and returns to the original state, that is, a state in which the back pressure becomes the positive pressure which is higher than atmospheric pressure. Subsequently, similarly to the second embodiment, the reverse path side flashing operation (step S44) and the reverse path side wiping operation (step S43) are performed. In this manner, the reciprocative cleaning process, which includes the ink dropping operation (step S45) due to the pressurization, the wiping operation (step S42) that is performed while causing the wiper 711 to perform the forward path movement, the reverse path side flashing operation (step S44) and the wiping operation (step S43) that is performed while causing the wiper 711 to perform the reverse path movement, is completed one time.

Further, similarly to the first embodiment, after the reciprocative cleaning process (step S4) corresponding to the number Nmax of repetitions is performed, the wiper 711 is moved to the forward path side (left side) rather than the starting location P11 in the forward path movement, the ink circulation speed is reduced from the second speed V2 to the normal speed (first speed) V1, and thus the back pressure for the liquid surface in the nozzle is returned to the negative pressure which is lower than atmospheric pressure.

In the fourth embodiment, different types of head cleaning are combined and performed as above, and thus it is possible to increase cleaning effects, similarly to the third embodiment.

Others

As described above, in the embodiments, the printer 1 corresponds to an example of a "liquid discharge device" of the invention. The ink corresponds to an example of "liquid" of the invention, the sheet S corresponds to an example of a "medium" of the invention. The printing head 6 corresponds to an example of the "head" of the invention, and the wiper 711 corresponds to an example of a "wiping member" of the invention. In addition, the cleaning liquid supply pipe 73 corresponds to an example of a "cleaning liquid supply section" of the invention. In addition, the tank 81 corresponds to an example of a "liquid storage section" of the invention, and the ink circulation mechanism 80 corresponds to an example of a "circulation speed adjustment section" of the invention. In addition, the printing time corresponds to an example of a "time in which the liquid is discharged from nozzles" of the invention. In addition, the UV lamps 37*a*, 37*b*, and 38 correspond to examples of "light irradiation devices" of the invention. Further, step S3 corresponds to an example of a "speed adjustment procedure" of the invention, steps S41 and S44 correspond to an example of a "cleaning liquid supply procedure" of the invention, steps S42 and S43 correspond to an example of a "wiping procedure" of the invention.

Meanwhile, for convenience, the content of maintenance has been described for a case in which the nozzle forming surface 60 is approximately horizontal in the above description. However, even when the nozzle forming surface 60 is inclined from the horizontal surface, the maintenance unit 7U is arranged along the nozzle forming surface 60 in the wiping direction Dw, and thus it is possible to perform the maintenance which is described until now.

In addition, the invention is not limited to the above-described embodiment, and the components of the embodiment can be appropriately combined or various modifications can be added without departing from the gist of the invention. For example, in the embodiment, the number of repetitions of the reciprocative cleaning process (step S4) is changed according to the printing time. However, the number of repetitions of the reciprocative cleaning process (step S4) may be changed according to a distance from the UV lamps to the printing head 6. The reason for this is that ink, which is discharged from the nozzles 61, lands on the sheet S, receives light which is irradiated from the UV lamps 37*a*, 37*b*, and 38 and then hardens, and thus it is difficult to remove the ink from the nozzle forming surface 60. When the number of repetitions of a reciprocating operation, that is, the number of repetitions of the combined head cleaning is changed according to the distance, it is possible to perform cleaning which is suitable for a hardening degree. As a result, it is possible to reduce running costs by preventing excessive cleaning liquid from being used.

In addition, in the embodiment, the cleaning liquid is supplied to the side surfaces 64 and 65 of the printing head 6. However, the cleaning liquid may be directly supplied to the wiper 711. In this case, the cleaning liquid may be supplied to the vicinity of the upper end of the wiper 711 such that the cleaning liquid flows to the wiping surface 711*a* of the wiper 711 and are maintained in the wiper 711.

In addition, in the embodiment, wiping is performed by causing the wiper 711 to move in the wiping direction Dw. However, wiping may be performed by causing the nozzle forming surface 60, that is, the printing head 6 to move in the wiping direction Dw. In addition, it is possible to perform wiping by causing both the wiper 711 and the printing head 6 to move in the wiping direction Dw.

In addition, the detailed configuration of the printer 1 may be appropriately changed, and arrangement of the printing head 6 or the maintenance unit 7U and the number of printing heads 6 or the maintenance units 7U may be appropriately changed, and the shape of the platen drum 30 may be appropriately changed.

In addition, the type of ink which is discharged from the nozzles 61 is not limited to the above-described UV ink. Further, it is possible to apply the invention to a liquid discharge device which discharges liquid other than ink.

The entire disclosure of Japanese Patent Application No. 2015-048074, filed Mar. 11, 2015 is expressly incorporated by reference herein.

What is claimed is:

1. A liquid discharge device, which discharges liquid from nozzles that are formed on a nozzle forming surface of a head while circulating the liquid between a liquid storage section and the head at a first speed, the liquid discharge device comprising:

a wiping member that performs wiping on the nozzle forming surface by being caused to perform relative movement on the nozzle forming surface while coming into contact with the nozzle forming surface;

a cleaning liquid supply section that supplies cleaning liquid to at least one of the head and the wiping member; and a circulation speed adjustment section that is capable of adjusting a circulation speed of the liquid, which is circulated between the liquid storage section and the head, to a second speed which is faster than the first speed and to a third speed which is faster than the second speed, wherein the liquid discharge device performs a reciprocating operation in which the wiping member is caused to perform a forward path wiping operation which is the relative movement in a first direction along the nozzle forming surface and a reverse path wiping operation which is the relative movement in a second direction which is opposite to the first direction after the forward path wiping operation, wherein the cleaning liquid supply section supplies the cleaning liquid and the circulation speed adjustment section adjusts the circulation speed to the second speed before the forward path wiping operation and the circulation speed adjustment section adjusts the circulation speed to the third speed between the forward path wiping operation and the reverse path wiping operation, or wherein the circulation speed adjustment section adjusts the circulation speed to the third speed before the forward path wiping operation and the cleaning liquid supply section supplies the cleaning liquid and the circulation speed adjustment section adjusts the circulation speed to the second speed between the forward path wiping operation and the reverse path wiping operation.

2. The liquid discharge device according to claim 1, wherein the cleaning liquid supply section supplies the cleaning liquid before the wiping member performs the relative movement in the first direction and the wiping member performs the relative movement in the second direction.

3. The liquid discharge device according to claim 1, wherein the number of repetitions of the reciprocating operation is changed according to time in which the liquid is discharged from the nozzles.

4. The liquid discharge device according to claim 1, further comprising:

a light irradiation device that causes the liquid, which is discharged from the nozzles and lands on a medium, to harden by irradiating the liquid with light, wherein the number of repetitions of the reciprocating operation is changed according to a distance from the light irradiation device to the head.

5. A head cleaning method for cleaning a head in a liquid discharge device, which discharges liquid from nozzles that are formed on a nozzle forming surface of the head while circulating the liquid between a liquid storage section and the head at a first speed, the head cleaning method comprising:

supplying cleaning liquid to at least one of a wiping member, which comes into contact with the nozzle forming surface, and the head;

performing wiping on the nozzle forming surface by causing the wiping member and the nozzle forming surface to perform relative movement; and adjusting a circulation speed of the liquid, which is circulated between a liquid storage section and the head during the wiping, to a second speed which is faster than the first speed and to a third speed which is faster than the second speed, performing a reciprocating operation in which the wiping member is caused to perform a forward path wiping operation which is the relative movement in a first direction along the nozzle forming surface and a reverse path wiping operation which is caused to perform the relative movement in a second direction which is opposite to the first direction after the forward path wiping operation, supplying the cleaning liquid and adjusting the circulation speed to the second speed before the forward path wiping operation and adjusting the circulation speed to the third speed between the forward path wiping operation and the reverse path wiping operation, or adjusting the circulation speed to the third speed before the forward path wiping operation and before supplying the cleaning liquid and adjusting the circulation speed to the second speed between the forward path wiping operation and the reverse path wiping operation.

* * * * *